US005772111A

United States Patent [19]

Kirsch

[11] Patent Number: 5,772,111

[45] Date of Patent: Jun. 30, 1998

[54] CONTAINER STRUCTURE

[76] Inventor: John M. Kirsch, 1720 Casimir Rd., Stevens Point, Wis. 54481

[21] Appl. No.: 640,521

[22] Filed: May 1, 1996

Related U.S. Application Data

[60] Provisional application No. 60/013,273 Mar. 12, 1996.

[51] Int. Cl. [6] ..... B65D 3/22

[52] U.S. Cl. ..... 229/403; 220/441; 229/939; 428/182

[58] Field of Search ..... 229/4.5, 400, 403, 229/939; 220/441, 443; 428/182

[56] References Cited

U.S. PATENT DOCUMENTS

| | | | |
|---|---|---|---|
| Re. 25,618 | 7/1964 | Goodman . | |
| 3,157,335 | 11/1964 | Maier . | |
| 3,194,468 | 7/1965 | Baron . | |
| 3,237,834 | 3/1966 | Davis et al. . | |
| 3,456,860 | 7/1969 | Jannick . | |
| 3,495,736 | 2/1970 | Ragettli | 220/72 |
| 3,908,523 | 9/1975 | Shikaya . | |
| 4,288,026 | 9/1981 | Wilhelm . | |
| 4,993,580 | 2/1991 | Smith | 229/939 |
| 5,092,485 | 3/1992 | Lee | 220/441 |
| 5,205,473 | 4/1993 | Coffin, Sr. | 229/939 |
| 5,226,585 | 7/1993 | Varano . | |
| 5,267,685 | 12/1993 | Sorensen . | |
| 5,314,738 | 5/1994 | Ichikawa | 428/182 |
| 5,363,982 | 11/1994 | Sadlier | 220/441 |
| 5,385,260 | 1/1995 | Gatcomb | 220/415 |
| 5,568,877 | 10/1996 | Rench | 229/939 |

*Primary Examiner*—Gary E. Elkins
*Attorney, Agent, or Firm*—Thomas D. Wilhelm

[57] ABSTRACT

This invention pertains to an upstanding container having a corrugated sidewall. Flutes in the medium of the corrugated sidewall follow preferably equal and opposite alternating lateral divergences from generally longitudinal upstanding axes. Preferred alternating divergences are waves having gradually changing angles of divergence from the respective upstanding axes. Thus, preferred medium is characterized by a pattern of wavy flutes. The pattern of wavy flutes provides improved strength and rigidity imparted by the horizontal components of the waves. Wavelength of the flutes is generally no greater than the height of the container. Wave amplitude is preferably between about 1/20th and about 1/80th of the circumference of the container. Spacing between flutes may be uniform from top to bottom of the container. In some embodiments, spacing between flutes is greater at or adjacent the top of the container than at or adjacent the bottom of the container.

51 Claims, 6 Drawing Sheets

CONTAINER STRUCTURE

This application claims priority under 35 U.S.C. 120 from Provisional Application Ser. No. 60/013,273, filed Mar. 12, 1996, herein incorporated by reference in its entirety.

FIELD OF THE INVENTION

This invention relates to packaging products such as open top containers and, more preferably, to improvements in container structure to enhance strength and/or thermal insulating properties in combination with economy of fabrication and use.

BACKGROUND OF THE INVENTION

This invention pertains to packaging products having a single upright wall defining a closed perimeter of the package. Such packaging products can have cylindrical shapes, conical shapes, and frustoconical shapes, as well as other closed configurations having e.g. circular or elliptical cross-sections. In this disclosure, frustoconical cup-shaped packages are described in some detail. The principles herein described apply as well to the other packaging shapes. For sake of brevity of illustration, the invention is described only in terms of a single-use container (e.g. cup), commonly used as a single-use coffee cup. Given the description herein, applications to other container shapes will be obvious to those skilled in the art.

In the food service and cup industries, it is desirable for a cup to have sufficient strength and rigidity to hold a variety of liquids, and to withstand normal holding and other use by the consumer of the liquid contained in the cup. It is also desirable for the cup or container to have a sidewall which insulates the user's hand from the temperature of the contents of the cup, especially where the contents of the cup are relatively hot (e.g. coffee or soup).

Foam cups molded from plastic materials such as foamed polystyrene have desirable insulating characteristics, but may lack in strength and rigidity characteristics unless high amounts of plastic are used. Also, such cups are made from generally non-renewable raw materials based on crude oil.

Paper cups can have the desirable feature of biodegradability, and are made from renewable raw materials, but commercially available paper cups generally lack thermal insulating ability. Some such cups are also weak in strength and/or rigidity.

It is an object of this invention to provide a container fabricated primarily with renewable raw materials, including a corrugated material, providing excellent thermal insulating characteristics as well as strength and rigidity to prevent longitudinal deformation, and resistance to folding or bending across the width of the container.

It is another object to provide a container, made primarily with renewable raw materials, having excellent balance of thermal insulating characteristics in combination with excellent strength and rigidity, relative to the amount of material used to fabricate the cup.

It is yet another object to provide a cup having enhanced inherent ease of gripping.

It is still another object of this invention to provide a container having an outer layer highly receptive to high quality, low cost, printing.

SUMMARY OF THE DISCLOSURE

The invention is generally directed to a container comprising an enclosing sidewall surrounding and defining an opening, a circumference about the opening, and a bottom wall closing off the opening at one end. The sidewall comprises a substrate layer, and a corrugated medium secured to the substrate layer, a top edge and a bottom edge. The corrugated medium includes a plurality of generally longitudinal flutes extending upwardly along flute paths, on the sidewall to a locus adjacent the top edge, the flute paths following alternating lateral divergences from a generally upstanding axis.

Various flute patterns are contemplated. Preferably, the flute paths have gradually changing angles of divergence from the respective upstanding axes. Alternately, the flute paths can have step angle changes alternating between left and right divergences from the upstanding axes.

In some embodiments, the distance between two adjacent ones of the flutes is uniform along the length of the flutes. In other embodiments, the distance between adjacent ones of the flutes proximate the top edge is greater than the distance between respective adjacent ones of the flutes proximate the bottom edge, such that the number of flutes proximate the top edge equals the number of flutes proximate the bottom edge.

In preferred embodiments, the straight-line wavelengths of the flute paths are no more than the height of the sidewall. In more preferred embodiments, at least two wavelengths are defined along the respective paths between the bottom edge and the rim zone.

Some embodiments include a second substrate layer secured to the corrugated medium by adhesive or other suitable attachment means, the second substrate layer covering at least a portion of the corrugated medium.

In preferred containers of the invention, the materials of construction of the sidewall and the bottom wall are biodegradable.

Figure 1A:
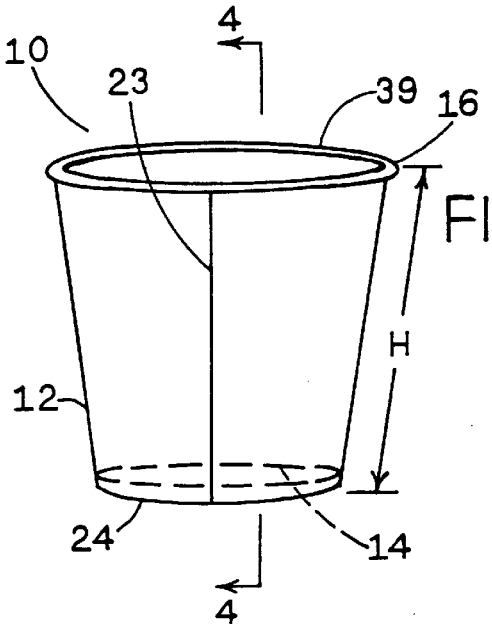
FIGS. 1A–1C show representative pictorial views of novel containers of the invention.

It is to be understood that the invention is not limited in its application to the details of construction and the arrangement of the components set forth in this description or illustrated in the drawings. The invention is capable of other embodiments or of being practiced or carried out in various ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

Figure 1C:
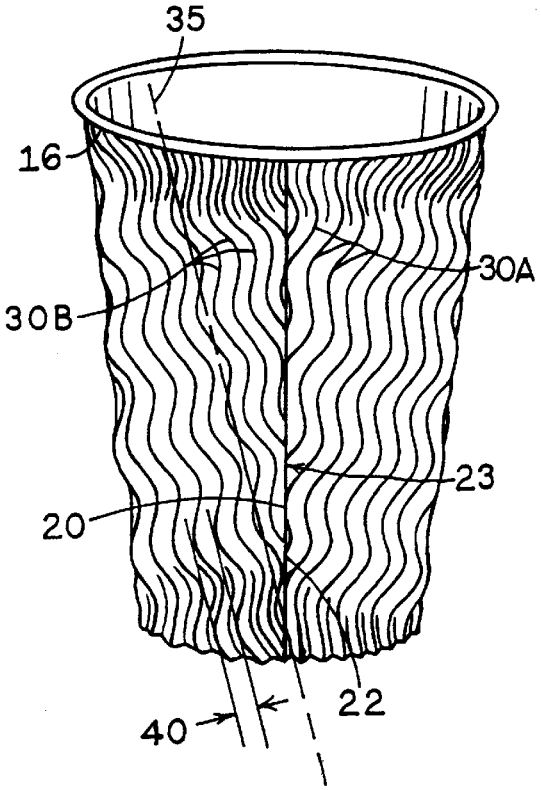
Figure 1B:
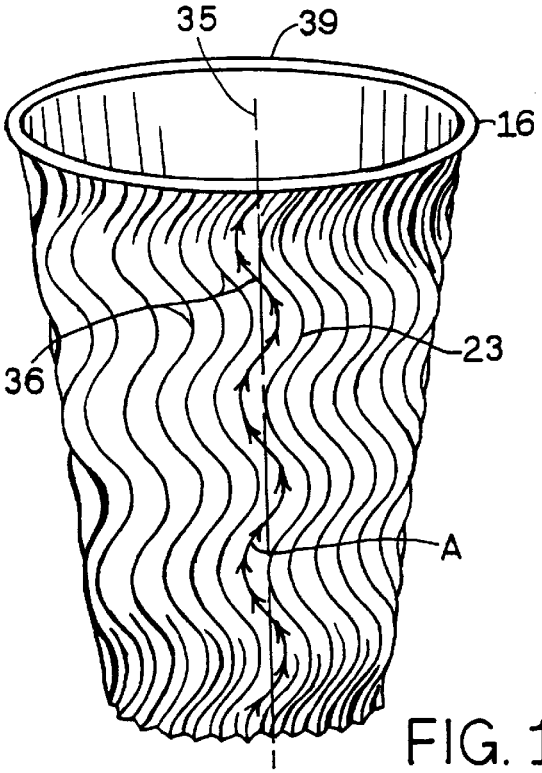
Figure 2:
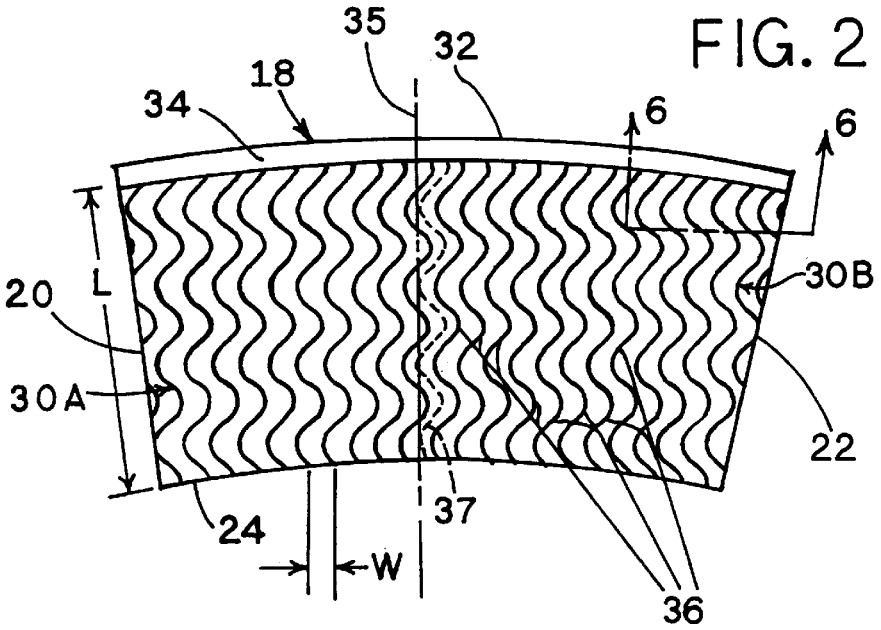
FIG. 2 shows an arcuate trapezoidally-shaped blank using wave-fluted corrugated sheet material to form the sidewall of the container shown in FIG. 1C.

Referring now by characters of reference to the drawings, and first to FIGS. 1A–1C and 2, FIG. 1A shows generally a cup or container 10. Cup or container 10 includes a sidewall 12, a circular bottom wall 14, and an outwardly turned rim 16. As illustrated in FIG. 2, sidewall 12 is fabricated by forming an arcuate trapezoidally-shaped 2-layer corrugated blank 18 into a frustoconical configuration having an annular, typically circular cross-section. Opposing side edges 20, 22 of the blank are attached to each other by adhesive, heat sealing or other suitable attachment means, to form a liquid tight seam 23. The bottom wall 14 and the sidewall 12 are secured to each other adjacent bottom edge 24 of sidewall 12 by adhesive or other suitable attachment means to form a liquid tight seal. Paper is the preferred material of construction for both sidewall 12 and bottom wall 14, to provide biodegradability.

Figure 6:
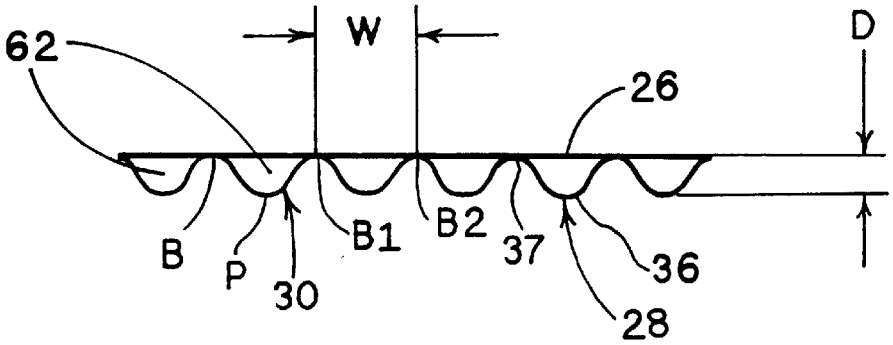
FIG. 6 shows a cross-section of the blank taken at 6—6 in FIG. 2, illustrating the depth, width, and spacing of the concavo-convex flutes.

Referring to FIGS. 2 and 6, the blank 18 is comprised of a substrate layer 26 and a corrugated medium 28. The substrate layer 26 and the corrugated medium 28 are attached to each other by adhesive or other suitable attachment means. The corrugated medium 28 is characterized by a pattern of wavy flutes 30 extending from the bottom edge 24 of the blank to a locus proximate but below the top edge 32 of the blank 18, and from the left edge 20 to the right edge 22 of the sidewall blank. A top rim zone 34 of the blank 18, and respectively sidewall 12 of the cup, is devoid of fluting such that the rim 16 is formed from the material of substrate layer 26 in rim zone 34.

In some embodiments, the blank 18 is constructed with flutes 30 extending the full bottom-to-top height of the blank 18. The strengthening effect of the fluting is reduced in the rim zone by crushing the existing flutes 30 in the rim zone, or by cutting the medium 28 away from the substrate layer 26 in the rim zone, leaving only substrate layer 26 at rim zone 34 or the substrate layer plus the crushed medium 28.

Referring to FIG. 2, each flute has a length "L" running from the bottom of the blank to the rim zone 34 at a locus proximate, but displaced downwardly from, top edge 32, along a wavy path 36 described more fully hereinafter. Each flute is secured by adhesive or the like to substrate layer 26 at flute bases "B," (e.g. B1 and B2) on opposing sides of the respective flute. Each flute has a peak "P" most remote from the substrate layer, and bases B1, B2 on opposing sides of peak "P." The medium 28 is adhesively secured to substrate layer 26 at bases "B1" and "B2." Each flute has a width "W" between its bases (e.g. B1, B2), and a depth "D" between substrate layer 26 and peak "P."

Figure 3:
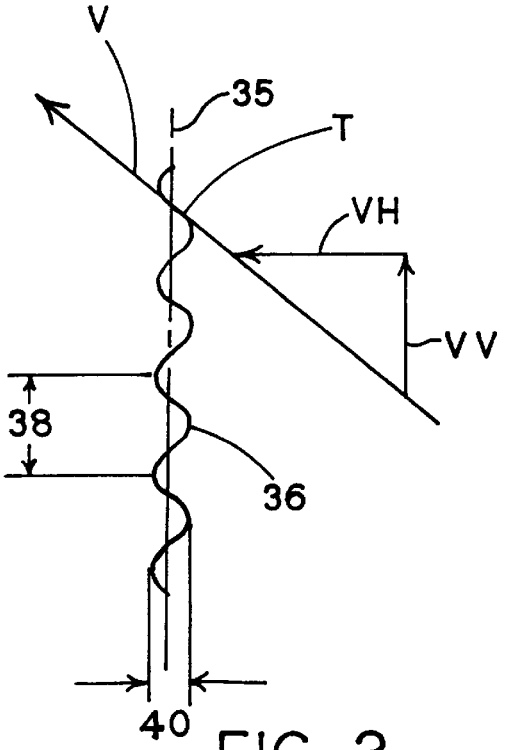
FIG. 3 shows a representation of a wave path traversed by the peak of a single flute, such as from the bottom of the container to the top of the container.

FIG. 3 illustrates the wavy path 36 of the peak "P" of a single flute as the flute traverses the height "H" from the bottom 24 of the cup to the rim zone 34. Similarly, the respective bases (e.g. B1, B2) traverse wavy paths 37 from the bottom of the cup to the rim zone, paths 37 being generally parallel, or nearly parallel, to paths 36. A single wavy path 37 of a base "B" is illustrated in dashed outline in FIG. 2.

The wavy paths 36, 37 have both lateral, typically horizontal, vector components and upstanding, typically vertical, vector components, with the lateral components being alternately directed to the left and then to the right of the upstanding axes 35 which represent the general upward directions of the respective back and forth alternating paths 36 of the flutes.

As illustrated in FIGS. 2 and 3, the wavy paths 36, 37 preferably define generally equal and opposite alternating horizontal divergences from typically (though not necessarily) straight, upwardly directed axes 35. The wavy paths 36 of peaks "P" have wavelengths 38 defined by the distance between repetitions of the wave pattern.

Each wavy path 36 also has a left-to-right amplitude 40 defined by the perpendicular distance between the maximum left and right divergences of the wavy path 36 from the respective axis 35. Generally, the straight-line wavelength 38 is less than the straight-line length "L" of the flute, the length "L" corresponding generally to height "H" of the sidewall 12 after the blank 18 is formed into the sidewall, and the rim 16 is formed.

In preferred embodiments, at least two wavelengths 38 are defined along the path 36 between bottom 24 and top 39 of the cup. In more preferred embodiments, 3 to 5 wavelengths are defined along the path 36. In an eight fluid ounce cup having height "H" of about 3.8 inches, four wavelengths are most preferred.

Figure 4:
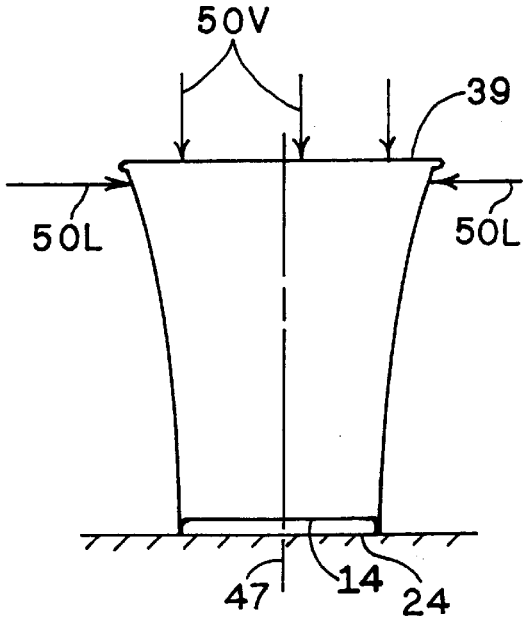
FIG. 4 shows a vertical cross-section taken at 4—4 of FIG. 1A, and illustrating transverse direction deformation of the container.
Figure 5:
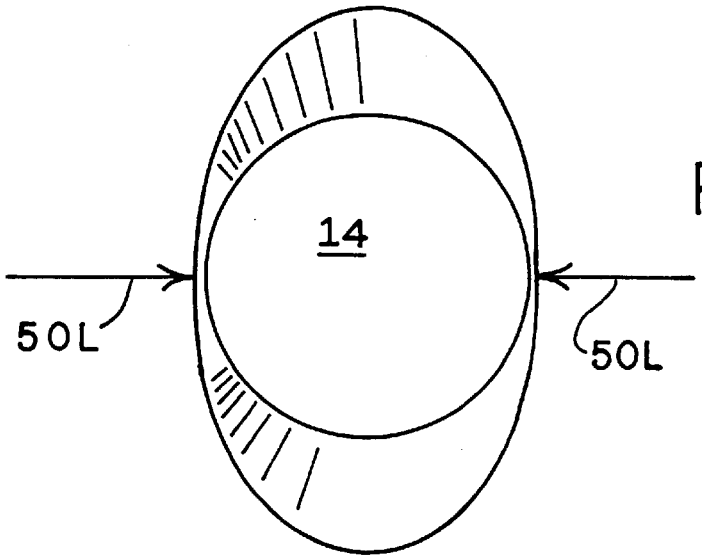
FIG. 5 shows a top view of the deformed container of FIG. 4.

Referring to the wavy path 36 illustrated in FIG. 3, a path vector "V" is shown tangential to the path 36 at point "T." The path vector "V" includes a vertical vector component "VV" and a horizontal vector component "VH." Applying this vector model to the corrugated container 10 shown in FIG. 1, vertical vector component "VV" of the fluting 30 provides resistance to deformation and crushing along longitudinal axis 47 due to a downward, or upward, applied force 50V as illustrated in FIG. 4. The horizontal vector component "VH" of fluting 30 provides resistance to bending or folding due to laterally applied forces such as squeezing of the cup as illustrated at 50L in FIGS. 4 and 5.

The back and forth zig-zag nature of wavy path 36 in part defines the amount of resistance to deformation along the longitudinal axis 47 of the cup (FIG. 4) and resistance to transverse squeezing, folding, or bending. Also, depth "D" and width "W" of the flutes 30 affect the amount of resistance to bending, both along, and transverse to, longitudinal axis 47.

Figure 9:
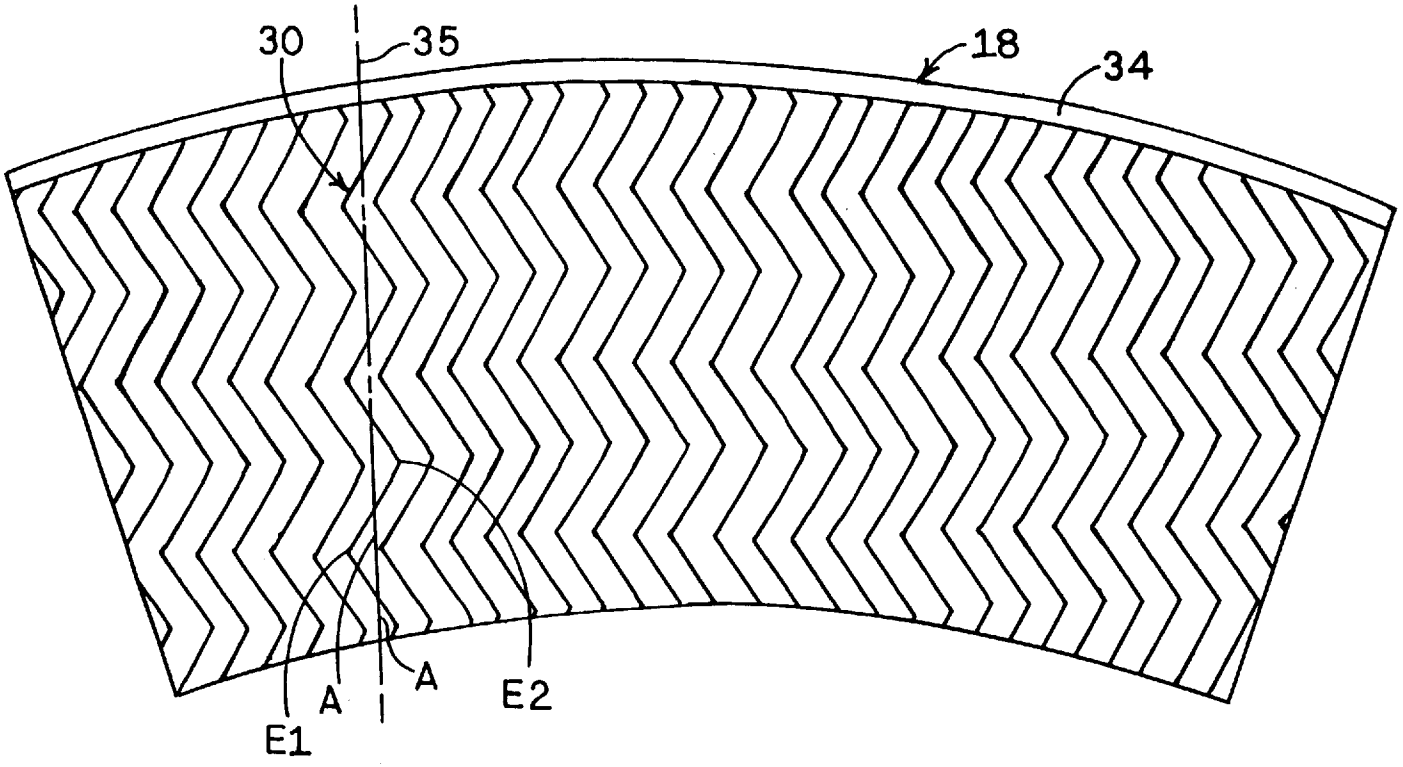
FIG. 9 shows an arcuate trapezoidally-shaped blank using corrugated sheet material having V-shaped zig-zag diagonal fluting, for forming the sidewall of the container shown in FIG. 1B.
Figure 10:
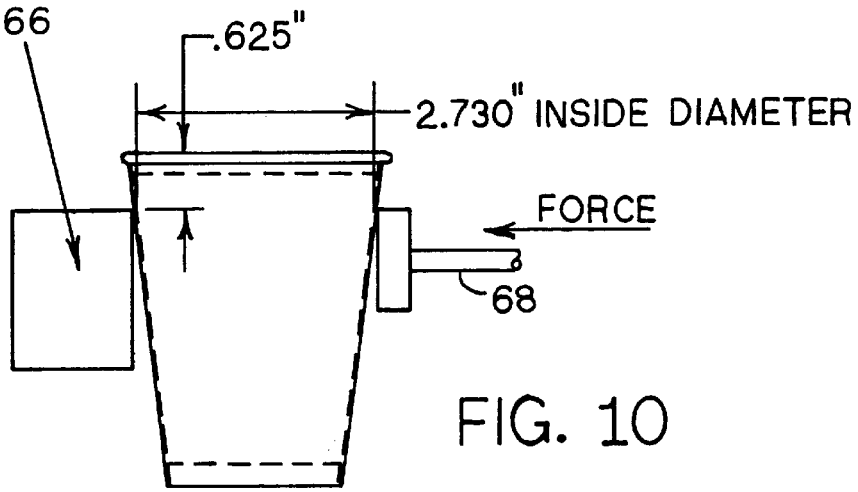
FIG. 10 shows a side elevation of a test set-up for testing the cups for resistance to lateral deflection.

As illustrated in FIG. 9, other fluting patterns having alternating lateral divergences from generally upstanding axes 35 are contemplated. FIG. 9 shows a blank 18 wherein the flute pattern contains alternating segments of a V-shaped, zig-zag path transitioning back and forth across axes 35, at preferably acute angles to the axis, between alternating left and right lateral divergences from upstanding axes 35. Each wavelength 38 includes two wave segments. A first segment "S1" extends to the left along a generally straight line across the respective axis 35 to a first end point "E1." From there, a second segment "S2" extends to the right along a generally straight line across the same axis 35 to a second end point "E2," thus defining the entire wavelength 38 with the first and second segments "S1" and "S2." The first and second segments in the embodiment of FIG. 9 generally define approximately equal and opposite acute angles "A" with the axis 35, and repeat along the respective axis 35 to the end of the respective flute 30.

A medium 28 having wavy paths 36 is preferred because of the lesser stresses on the medium at the loci of the extremes of amplitude. Stresses in wavy paths 36 are less, compared to other alternating flute patterns, (i) when the flute pattern is formed, (ii) when the sidewall 12 is wrapped into the frustoconical cup configuration, and (iii) if and when the cup is squeezed by the user.

The wavelength 38 and amplitude 40 of wavy path 36 determine the degree to which lateral or horizontal vector components "VV", "VH" operate to strengthen and make rigid the sidewall 12 which is made with the wavy flute pattern. FIG. 1B illustrates the ongoing and gradual change along path 36 of the angle "A" between path 36 at any given point and the respective axis 35, the instantaneous angle "A" at any given point along the path 36 affecting the magnitudes of resistance to forces 50V and especially 5OL at that point.

In general, the wavelength 38 should be no more than the height "H" of the cup in order to obtain at least minimal bending resistance from the horizontal vector "VH." Accordingly, wavelength 38 should be between about 0.1 times and about 1 times the height "H" of the cup, preferably between about 0.15 times and about 0.7 times the height "H," and most preferably between about 0.15 times and about 0.4 times the height of the cup.

For a given wavelength 38, amplitude 40 must be large enough that lateral or horizontal vector "VH" supplies effective bending resistance while being small enough to allow for forming blank 18 into the conical shape of the cup 10 without damaging medium 28. For example, in a preferred corrugate medium, amplitude 40 defines a fraction of about 1/20th to about 1/80th of the circumference of the cup 10 at top 39. Preferred amplitude is about 1/40th to about 1/60th of the circumference of the cup.

For an e.g. 8 fluid ounce cup having a height of about 3.8 inches, top circumference of about 9 inches, a preferred amplitude 40 is about 0.12 inch to about 0.24 inch, most preferably about 0.18 inch. Wavelength 38 is about 0.9 inch. The flutes are regularly spaced from each other about the circumference of sidewall 12. The depth "D" of the corrugation is about 0.05 inch. Other wavelengths, amplitudes, and depths are contemplated.

There is a practical upper limit to amplitude 40 and an upper limit to depth "D," based on increasing resistance to bending or folding resulting from the horizontal vector component "VH" as the respective limits are approached. As those skilled in the art will appreciate, the actual limits depend on a variety of parameters related to the fluting, of which amplitude and depth "D" are only two. Nevertheless, as amplitude 40 increases for a constant depth "D," the horizontal vector component "VH," and therefore the resistance to bending, increases. With excessive amplitude 40, the resistance to bending prevents the blank 18 from being formed into a circular configuration to form the frustoconical sidewall 12. If the forming is forced under such conditions, the corrugated structure is damaged or destroyed. Likewise, increasing the depth "D," while holding amplitude 40 constant, yields a similar practical upper limit as depth "D" is increased.

While a preferred number of wavelengths has been given, so long as the amplitude and/or depth limits are not violated, which violation is evidenced by destruction of the corrugated structure, there is theoretically no upper limit on the number of wavelengths 38 along the respective paths 36.

In the embodiments illustrated in FIGS. 2 and 6, the flute width "W" is regular insomuch as the distance between bases "B1" and "B2," and respectively between adjacent flutes, is uniform along the length of the respective flutes, and thus from the bottom edge 24 of the cup to the tops of the respective flutes adjacent top edge 39 of the cup. Referring now to FIG. 1C, due to the arcuate trapezoidal shape of the blank 18, when the blank 18 is formed into the frustoconically-shaped sidewall 12, the wavy flutes 30A at side edge 20 intersect respective wavy flutes 30B at side edge 22, resulting in an irregular seam 23.

Figure 8:
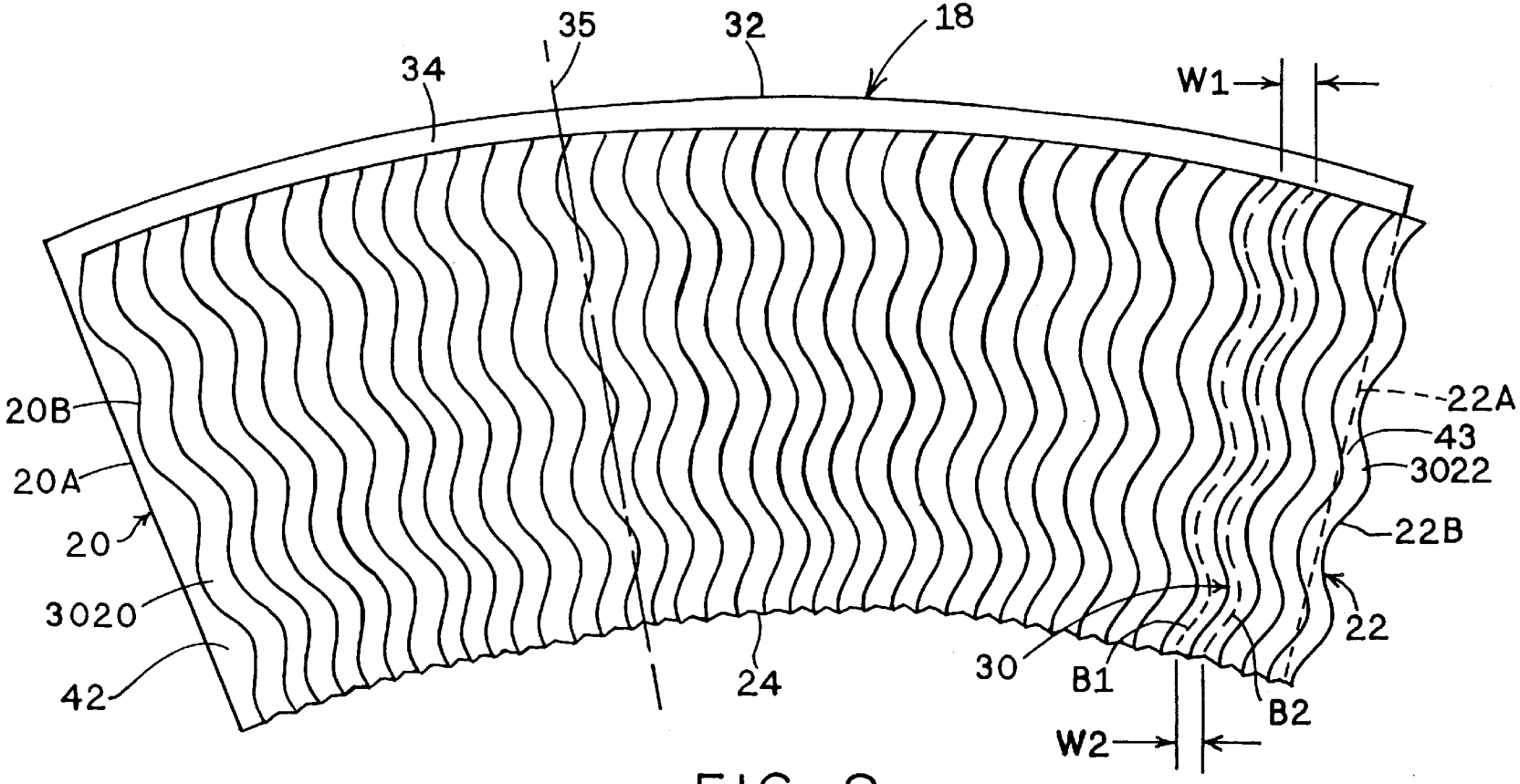
FIG. 8 shows an alternate arcuate trapezoidally-shaped blank using wave-fluted corrugated sheet material, for forming the sidewall of the cup.

FIG. 8 illustrates a blank 18 wherein the flute spacing varies from bottom to top of the blank, and thus from bottom to top, of the respective cup. The width "W1" of a flute 30 between respective bases "B1" and "B2" at the top of blank 18 is greater than the width "W2" at the bottom of blank 18, such that the number of flutes 30 or paths 36, 37 proximate top edge 32 equals the number of flutes 30 or paths 36, 37 proximate or intersecting bottom edge 24. In a sample blank 18 of this nature, for an 8 fluid ounce cup, a preferred width "W1" proximate top 39 is about 0.19 inch and a respective preferred width "W2" proximate bottom edge 24 is about 0.125 inch. The distance between flutes adjacent top edge 32 is about 40% to about 60%, preferably about 50%, greater than the respective distance between flutes adjacent bottom edge 24.

Blank 18 of the FIG. 8 embodiment includes the previously mentioned left edge 20 and right edge 22. However, unlike the previous embodiments, the left and right edges 20, 22 do not correspond with respective left and right edges of both substrate 26 and medium 28. As seen in FIG. 8, the left and right edges 20A, 22A of substrate layer 26 are represented by straight lines, as in the previous embodiments. The respective left and right edges 20B, 22B of medium 28, however, are wavy, and generally reflect the paths 36, 37 of the closest respective adjacent flutes 30. Further, ends 20B, 22B are laterally displaced to the right of respective ends 20A, 22A, as seen in FIG. 8. Accordingly, edge 20B of medium 28 partially overlies and/or borders an edge portion 42 of substrate 26 adjacent edge 20, and edge 22A of substrate 26 underlies an edge portion 43 of medium 28 adjacent edge 22.

When blank 18 is formed into the frustoconical sidewall 12, the edge flute 3022 at edge 22 overlies edge portion 42 and butts up against edge flute 3020 at edge 20 to make a wavy seam 23 wherein the seam at medium 28 tracks the paths 36, 37 of the adjacent flutes. Thus, the wavy seam 23 has the same general appearance at the outside surface of the cup as the rest of the circumference of sidewall 12. See, for example, FIG. 1B, where wavy seam 23 is not generally distinguishable in sidewall 12. Edges 20A, 22A preferably abut each other at the inside surface of sidewall 12, but may overlap. The bonding together of edges 20, 22 to make seam 23 preferably corresponds to adhesive bonding between flute 3022 of medium 28 and edge portion 42 of substrate layer 26. However, bonding may occur at overlapped portions of ends 20A, 22A.

In addition to the strength advantages of the container or cup 10 described above, the air spaces 62 between medium 28 and substrate layer 26 serve to effectively insulate the outer surface of the container 10, as at peaks "P," from the liquid material contained in the cup, and to space the user's hand from any heat of the contained liquid which may be present at layer 26. This allows a hot liquid (e.g. coffee, soup, etc.) to be placed in the cup or container 10 and handled comfortably by a user of the container, whereby the temperature perceived by the user at the outer surface of sidewall 12 is generally the temperature at peaks "P," which is generally no greater than about 140 degrees F., preferably no greater than about 130 degrees F., more preferably no greater than about 120 degrees F, the user's hand being spaced from the heat in the substrate layer by medium 28.

A further advantage of the invention is the enhanced gripping surface provided by the horizontal vector component "VH" of the wavy corrugated sidewall material. Vector component "VH" provides resistance to slippage between cup and hand when a user holds the cup 10.

A corrugated paperboard material having essentially vertical, or otherwise straight upstanding flutes, and not having the combination of leftwardly and rightwardly advancing flute path components defined herein, provides less resistance to slipping and less resistance to lateral bending, than a corrugated material having flutes with the alternating left and right path components described herein for flute 30.

Figure 7:
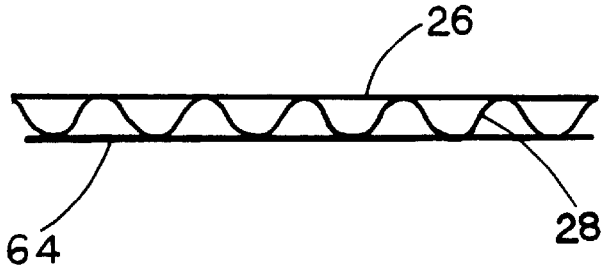
FIG. 7 shows a representative cross-section of an alternate 3-layer sidewall of cups or containers of the invention.

As illustrated in FIGS. 1 and 7, some contemplated embodiments include a second substrate layer 64 over at least a portion of the medium 28. The second substrate layer 64 can be secured to medium 28 either before, or preferably after, blank 18 is fabricated into the frustoconical sidewall 12 of the container. Second substrate layer 64 is preferably paper and thus provides an excellent surface for printing graphics or to otherwise enhance the visual appeal of the container. The second substrate layer 64 is attached to medium 28 by an adhesive or other suitable attachment means.

To illustrate the strength advantages of a container constructed from a blank 18 having wave fluted corrugation, samples were constructed and tested. Wave-fluted corrugate blanks having height "H" about 3.75 inches were cut into the shape of arcuate trapezoids as illustrated in FIG. 2, but without rim zone 34.

In the blanks, the number of wavelengths along length "L" was approximately 4. Amplitude 40 was 0.19 inch. Width "W" was 0.19 inch. Depth "D" was 0.05 inch.

Each blank 18 was formed into a frustoconically-shaped sidewall disposed about a standard bottom taken from a standard 8 fluid ounce hot drink cup sold commonly under the trade name of DIXIE®, registered to James River Corporation, Norwalk, Conn. The side edges 20 and 22 were joined with conventional adhesive to form base cups. A top rim, cut from the same 8 fluid ounce DIXIE® cups, was also attached to some of the base cups with conventional cup adhesive to form rimmed cups, simulating rolling of the rim at rim zone 34.

Figure 11:
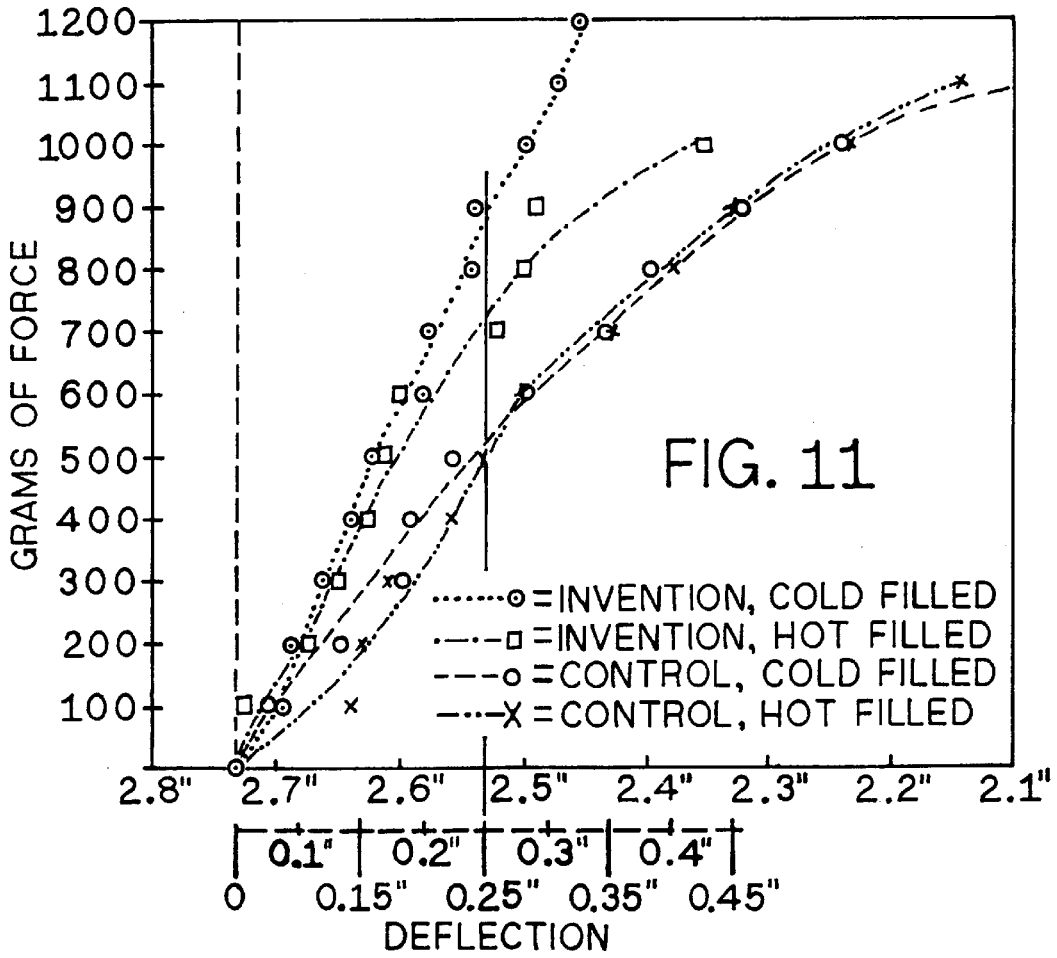
FIG. 11 is a graph showing resistance to lateral deflection.

The cups were tested for resistance to lateral deformation, or lateral crushing, namely applied force 50L. The cups tested had an overall height. The overall test set-up is illustrated in FIG. 11. Thus, the cup was placed against a stationary V-block 66 on one side. A plunger 68 was then urged against the cup sidewall from the opposite side, using an AMETEK/HUNTER SPRING® Model LKG-1 Force Gauge. A dial readout gauge on the plunger, having a range of 0–1300 grams, indicated pressure on the plunger along its longitudinal axis, thus in a direction laterally across the cup.

With both the V-block and the plunger in contact with the cup, with the gauge zeroed and reading zero, and prior to any force being applied to the cup, the distance across the inside of the cup was measured at the top of the cup, between the V-block and the plunger, with the dial caliper. This provided a control, rest, unloaded dimension of each cup prior to any testing of lateral crush resistance.

In this and all subsequent cross-cup distance measurements, the measurement was taken by expanding the caliper until a slight change in force was observed on the dial readout gauge attached to the plunger, and then retracting the caliper until the dial readout gauge returned to its previous reading. This procedure effectively used the readout gauge to ensure that the caliper did not change the cross-cup dimension in the process of taking the measurement.

The force 50L was applied below rim 16, at 0.625 inch below the top of the cup. Starting from the rest position, plunger 68 was advanced against the cup until a resistance of 100 grams was recorded on the readout gauge, indicating that the cup was resisting the squeezing by the combination of V-block and plunger with a force of 100 grams.

Advance of the plunger was stopped, and consistency of the 100 gram reading was observed. If the reading dropped, plunger 68 was again advanced incrementally until a steady 100-gram reading was obtained. If the reading was over 100 grams, the plunger was retracted until a steady reading of 100 grams was obtained.

With the readout gauge showing a steady indication of 100 grams, the cross-cup distance was measured with the caliper and recorded, using the above described procedure.

Plunger 68 was again advanced and adjusted as above until a 200-gram reading was indicated on the readout gauge. Again the cross-cup distance was measured and recorded as described above.

The above procedure was repeated for readout indications at 100 gram intervals, and the results recorded. Where a cup was unstable, or collapsed, same was recorded.

Cups of the invention (8 fluid ounce size) were tested while holding hot water, and cold water. Similar 8 fluid ounce DIXIE® cups were also tested as control.

TABLE 1 shows the numerical results. Cross-cup distances are in inches. Force measurements are grams. FIG. 12 shows the results in graph form.

TABLE 1

Deformation Test Results

| Resistance | CROSS-CUP DIMENSION | | | |
|---|---|---|---|---|
| Force | Ex 1 | Ex 2 | Ex 3 | Ex 4 |
| 0 | 2.730 | 2.730 | 2.730 | 2.730 |
| 100 | 2.690 | 2.725 | 2.704 | 2.637 |
| 200 | 2.686 | 2.670 | 2.645 | 2.630 |
| 300 | 2.660 | 2.654 | 2.594 | 2.610 |
| 400 | 2.637 | 2.625 | 2.590 | 2.560 |
| 500 | 2.620 | 2.617 | 2.546 | 2.535 |
| 600 | 2.580 | 2.592 | 2.497** | 2.487** |
| 700 | 2.575 | 2.520 | 2.430** | 2.430** |
| 800 | 2.530 | 2.500 | 2.395** | 2.381** |
| 900 | 2.525 | 2.490 | 2.320** | 2.335** |
| 1000 | 2.494 | 2.354 | 2.238** | 2.234** |
| 1100 | 2.474 | *** | 2.034** | 2.138** |
| 1200 | 2.452 | | *** | *** |
| 1300 | 2.358* | | | |

Ex 1 Invention, cold water filled
Ex 2 Invention, hot water filled
Ex 3 Control, cold water filled
Ex 4 Control, hot water filled
* = Stable
** = Unstable
* = Collapsed FIG. 12 shows that the paper cups of the invention are stronger than the conventional paper cups. A second Abscissa scale in FIG. 12** is graduated to show the amount of deflection in inches. At a deflection of for example 0.25 inch, the conventional cups containing hot and cold water effectively resisted a force of 500 grams while the cups of the invention containing hot and cold water resisted forces of about 700 and about 900 grams respectively. Applicant attributes the increased resistance of cups of the invention to the wavy fluting on the cup sidewall.

Given the disclosure herein, those skilled in the art will see that the containers herein disclosed can be made from other materials as well as from the disclosed paper. Similarly conventional coatings and adhesives can be used in cups of the invention for effecting the various seals and obtaining liquid-tightness. All such materials and coatings are contemplated herein, especially those derived from polymers, generally known as plastics such as polyethylene, polypropylene, and/or polystyrene.

Containers of the invention include at least an enclosing sidewall 12, defining an opening therein having first and second ends. A bottom closes off the opening, typically at or adjacent the first end. A variety of lids and/or other closures can be used to close the opening, either permanently or temporarily, at the second end, the second end typically being considered the top of the container. Thus, where the container is a cup, a lid may be used to temporarily retain fluid in the cup until consumed by the user. Where the container represents a more permanent package such as for housing a product therein for shipment to the consumer or retailer, any of a variety of more permanently installed conventional closures may be adhesively or otherwise mounted in the opening to close the container.

Those skilled in the art will now see that certain modifications can be made to the apparatus herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

Having thus described the invention, what is claimed is:

1. A container, comprising:

(a) an enclosing sidewall surrounding and defining an opening and defining a circumference thereabout; and (b) a bottom wall closing off the opening at one end thereof, said sidewall comprising a substrate layer, and a corrugated medium secured to said substrate layer, said sidewall having a top edge and a bottom edge, said corrugated medium including a plurality of generally longitudinal flutes extending upwardly, along flute paths, on said sidewall to a locus adjacent said top edge, the flute paths following alternating lateral divergences from respective generally upstanding axes.

2. A container as in claim 1, the flute paths being wavy paths having gradually changing angles of divergence from the upstanding axes.

3. A container as in claim 1, the flute paths having step angle changes alternating between left and right divergences from the upstanding axes.

4. A container as in claim 3, the flute paths advancing back and forth across the respective upstanding axes at angles perpendicular to the upstanding axes.

5. A container as in claim 1, the distance between adjacent ones of said flutes being uniform along the lengths of said flutes.

6. A container as in claim 1, the distance between adjacent ones of said flutes proximate said top edge being greater than the distance between respective adjacent ones of said flutes proximate said bottom edge, such that the number of flutes proximate said top edge equals the number of flutes proximate said bottom edge.

7. A container as in claim 1, the distance between adjacent ones of said flutes proximate said top edge being between about 40% and about 60% greater than the distance between respective adjacent ones of said flutes proximate said bottom edge.

8. A container as in claim 1, said container having a first height, said sidewall having a second height generally corresponding to the first height, straight-line wavelengths (38) of the flute paths being defined by the distance between repetitions of the alternating lateral divergences, said wavelengths being no more than one time the first height of said sidewall.

9. A container as in claim 8, said wavelengths being no more than 0.5 times the height of said sidewall, at least two wavelengths thus being defined along respective ones of said paths.

10. A container as in claim 9, at least three wavelengths being defined along respective ones of said paths.

11. A container as in claim 1, the flute paths defining amplitudes (40) of about 1/20th to about 1/80th of the circumference of said container as defined at said top edge of said sidewall.

12. A container as in claim 1, the flute paths defining amplitudes (40) of about 1/40th to about 1/60th of the circumference of said container as defined at said top edge of said sidewall.

13. A container as in claim 1, including a second substrate layer secured to said corrugated medium about the circumference of said container, and covering at least a portion of said corrugated medium.

14. A container as in claim 2, the distance between adjacent ones of said flutes being uniform along the lengths of said flutes.

15. A container as in claim 2, the distance between adjacent ones of said flutes proximate said top edge being greater than the distance between respective adjacent ones of said flutes proximate said bottom edge, such that the number of flutes proximate said top edge equals the number of flutes proximate said bottom edge.

16. A container as in claim 2, the distance between adjacent ones of said flutes proximate said top edge being between about 40% and about 60% greater than the distance between respective adjacent ones of said flutes proximate said bottom edge.

17. A container as in claim 2, said container having a first height, said sidewall having a second height generally corresponding to the first height, straight-line wavelengths (38) of the flute paths being defined by the distance between repetitions of the alternating lateral divergences, said wavelengths being no more than one time the first height of said sidewall.

18. A container as in claim 17, said wavelengths being no more than 0.5 times the height of said sidewall, at least two wavelengths thus being defined along respective ones of said paths.

19. A container as in claim 18, at least three wavelengths being defined along respective ones of said paths.

20. A container as in claim 2 the flute paths defining amplitudes (40) of about 1/20th to about 1/80th of the circumference of said container as defined at said top edge of said sidewall.

21. A container as in claim 2, the flute paths defining amplitudes (40) of about 1/40th to about 1/60th of the circumference of said container as defined at said top edge of said sidewall.

22. A container as in claim 2, including a second substrate layer secured to said corrugated medium about the circumference of said container, and covering at least a portion of said corrugated medium.

23. A container as in claim 1, said container having a frustoconical configuration and comprising a cup; said sidewall comprising a sidewall blank having first and second opposing ends, said corrugated medium having third and fourth opposing ends, said third end corresponding to said first end and being generally parallel to the path of the closest respective said flute to said third end, said fourth end being adjacent and laterally displaced from said second end along said blank, about a small portion of the circumference of said container.

24. A container as in claim 1, said sidewall comprising a seam having alternating lateral divergences from a generally upstanding axis, and generally reflecting paths of the closest respective said flutes.

25. A container as in claim 1, said flutes extending from said bottom edge of said sidewall to a locus below said top edge, thus defining a rim zone devoid of fluting.

26. A container as in claim 25, including a rim formed in said rim zone and abutting said flutes on said sidewall.

27. A container as in claim 1, said flutes extending to said top edge, said flutes being crushed in a rim zone adjacent said top edge, and including a rim rolled in said rim zone, said rim including crushed portions of the flutes.

28. A container as in claim 2, said container having a frustoconical configuration, and defining a cup.

29. A container as in claim 3, said container having a frustoconical configuration, and defining a cup.

30. A container as in claim 4, said container having a frustoconical configuration, and defining a cup.

31. A container as in claim 5, said container having a frustoconical configuration, and defining a cup.

32. A container as in claim 6, said container having a frustoconical configuration, and defining a cup.

33. A container as in claim 7, said container having a frustoconical configuration, and defining a cup.

34. A container as in claim 8, said container having a frustoconical configuration, and defining a cup.

35. A container as in claim 9, said container having a frustoconical configuration, and defining a cup.

36. A container as in claim 10, said container having a frustoconical configuration, and defining a cup.

37. A container as in claim 11, said container having a frustoconical configuration, and defining a cup.

38. A container as in claim 12, said container having a frustoconical configuration, and defining a cup.

39. A container as in claim 13, said container having a frustoconical configuration, and defining a cup.

40. A container as in claim 24, said container having a frustoconical configuration, and defining a cup.

41. A container as in claim 27, said container having a frustoconical configuration, and defining a cup.

42. A container, comprising:

(a) an enclosing sidewall surrounding and defining an opening and defining a circumference thereabout; and (b) a bottom wall closing off the opening at one end thereof, said side wall comprising a substrate layer, and a corrugated medium secured to said substrate layer, said corrugated medium including a surface thereof defining, an outside surface of said sidewall, said sidewall having a top edge and a bottom edge, said corrugated medium including a plurality of generally longitudinal flutes extending upwardly, along flute paths, on said sidewall to a locus adjacent said top edge, the flute paths following alternating lateral divergences from respective generally upstanding axes, said container, when subjected to a lateral deformation test, being stable when subjected to an equivalent of 600 grams of force on an 8 ounce cup.

43. A container as in claim 42, said container, when subjected to a lateral deformation test, being stable when subjected to an equivalent of 700 grams of force on an 8 ounce cup.

44. A container as in claim 42, said container, when subjected to a lateral deformation test, being stable when subjected to an equivalent of 800 grams of force on an 8 ounce cup.

45. A container as in claim 42, said container, when subjected to a lateral deformation test, being stable when subjected to an equivalent of 900 grams of force on an 8 ounce cup.

46. A container as in claim 42, said container, when subjected to a lateral deformation test, being stable when subjected to an equivalent of 1000 grams of force on an 8 ounce cup.

47. A container as in claim 42, the flute paths being wavy paths having gradually changing angles of divergence from the upstanding axes.

48. A container as in claim 47, said container, when subjected to a lateral deformation test, being stable when subjected to an equivalent of 700 grams of force on an 8 ounce cup.

49. A container as in claim 47, said container, when subjected to a lateral deformation test, being stable when subjected to an equivalent of 800 grams of force on an 8 ounce cup.

50. A container as in claim 47, said container, when subjected to a lateral deformation test, being stable when subjected to an equivalent of 900 grams of force on an 8 ounce cup.

51. A container as in claim 47, said container, when subjected to a lateral deformation test, being stable when subjected to an equivalent of 1000 grams of force on an 8 ounce cup.

* * * * *